United States Patent [19]

Hayes

[11] 4,262,819

[45] Apr. 21, 1981

[54] TOOTHPASTE TUBE WITH LAMINATED HEADPIECE

[75] Inventor: Thomas H. Hayes, Baton Rouge, La.

[73] Assignee: Ethyl Corporation, Richmond, Va.

[21] Appl. No.: 65,186

[22] Filed: Aug. 9, 1979

[51] Int. Cl.[3] ..... B65D 35/10; B65D 35/16

[52] U.S. Cl. ..... 222/92; 113/120 D; 220/68; 229/4.5; 229/5.5

[58] Field of Search ..... 113/1 B, 1 E, 1 H, 120 D, 113/120 XY; 229/3.5 MF, 4.5, 5.5, 487; 220/417, 418, 68; 222/92, 107

[56] References Cited

U.S. PATENT DOCUMENTS

| | | | |
|---|---|---|---|
| 3,260,411 | 7/1966 | Dobson | 222/107 |
| 3,307,738 | 3/1967 | Scheindel | 229/48 T |
| 3,411,694 | 11/1968 | Silver | 229/48 T |
| 3,511,435 | 5/1970 | Hewitt et al. | 229/48 T |

*Primary Examiner*—David A. Scherbel

*Attorney, Agent, or Firm*—Donald L. Johnson; John F. Sieberth; David L. Ray

[57] ABSTRACT

A collapsible dispensing container having a laminated tubular body, the laminated tubular body including a metal foil lamination and a thermoplastic lamination, the collapsible dispensing container having a metal headpiece connected thereto, the metal headpiece having a thermoplastic film thereon which is heat fusible to the inner thermoplastic lamina of said collapsible dispensing container and an annular ring therearound which exposes the thermoplastic lamina in the headpiece to the inside lamina of the tubular body, the tubular body overlapping and covering the exposed edge of the ring.

5 Claims, 2 Drawing Figures

TOOTHPASTE TUBE WITH LAMINATED HEADPIECE

BACKGROUND OF THE INVENTION

The present invention relates to collapsible dispensing tubes and more particularly to tubes formed from a laminated material.

Collapsible dispensing tubes made of both metallic and plastic materials are well known. The metal tubes are generally impermeable to moisture and volatile oils and, therefore, are widely used for packaging pharmaceutical products, cosmetics, toiletries, and the like which contain these ingredients. They are also impervious to oxygen and hence capable of protecting a container product against deterioration from this source.

However, the metal tubes such as are made from lead or aluminum are costly to produce due to the high material cost and the manner in which the tubes must be made. This includes individual printing of each tube with suitable decorative material after it has been formed. Moreover, the chemical nature of the metals used often makes necessary the extra step of completely coating the interior of the tube with a protective layer so as to preclude attack and corrosion of the metal by alkaline or acid contents resulting in contamination of the contents of the reaction products.

On the other hand, plastic tubes are relatively inert and are better suited for many products that attack metal. Unfortunately, the thin body wall of the plastics generally used is apt to be permeable, in varying degrees, to moisture, certain essential oils, perfumes, flavorings, and other volatile ingredients. Consequently, there is often a considerable loss of volatile oils and moisture during storage, resulting in some deterioration or dehydration of contained products such as toothpaste, shaving cream, medicinal ointments, etc. Too, many plastics favored for plastic tube manufacture are oxygen permeable and are inferior to metal tubes in this respect.

Even where permeability is not a factor, plastic tubes have a further serious disadvantage in that printing or decorative material applied to the surface of the plastic will often not adhere readily, unless the plastic surface is first treated in some manner. This is an additional expense contributing to the cost of these tubes.

The Invention

In accordance with the present invention there is provided a collapsible dispensing container having a laminated tubular body including a metal foil lamina and a thermoplastic lamina, the collapsible dispensing container having a metal headpiece connected thereto, said metal headpiece having a thermoplastic film thereon which is heat fusible to the inner thermoplastic lamina of said collapsible dispensing container and an annular ring therearound which exposes the thermoplastic lamina in the headpiece to the inside lamina of the tubular body, the tubular body overlapping and covering the exposed edge of the ring.

DESCRIPTION OF THE PREFERRED EMBODIMENTS

Figure 1:
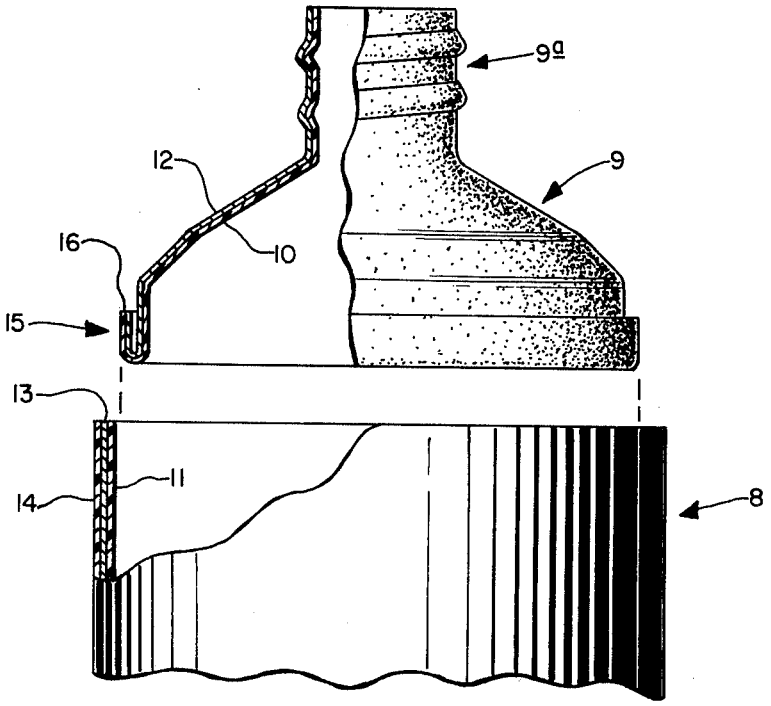
FIG. 1 is a side elevational, cross-sectional, partly cut-away view of the collapsible dispensing tube and headpiece of the present invention; and, FIG. 2 is a cross-sectional, cut-away detail of the portion of the headpiece which contacts the collapsible dispensing tube.

FIG. 1 shows a collapsible dispensing tube generally indicated by the numeral 8, having a tubular body with a longitudinally extending side seam (not shown). The tube 8 ordinarily is closed at one end after filling by heat sealing or other techniques as are well known in the art. The tubular body 8 mounts at its opposite end a metal headpiece generally indicated by the numeral 9, which is shaped to provide a threaded neck 9*a* so that a cap may be secured thereto when the tube is filled with product. Headpiece 9 is a laminate of a metal layer 12 with an interior lamina 10 of a thermoplastic material which can be fused by heat and/or pressure to thermoplastic lamina 11 of tubular body 8.

The tubular body 8, as shown in FIG. 1, comprises a plurality of layers laminated or otherwise bonded one to the other. The body 8 comprises an intermediate foil layer 13 which provides barrier protection against oxygen absorption from the atmosphere and essential oil permeation outward through the tubular body 8. The thickness of this metallic foil is sufficient to impart the requisite barrier properties and yet is maintained relatively thin in the interest of cost and pliability of the container during use. Aluminum foil has been found particularly suitable for this use although other metallic foils such as sheet steel or tin plate may also be utilized.

On the inside of foil layer 13 is layer 11. Layer 11 is a flexible thermoplastic polymer having low permeability to fluids which is heat fusible to lamina 10 on headpiece 9. Such heat fusible polymers having low permeability to fluids include, for example, polymers containing high nitrile content as those disclosed in U.S. Pat. No. 3,426,102. Other barrier polymers which may be used include polyester, polyvinyl chloride, and the like.

On the outside of foil layer 13 is layer 14, generally taking the form of a low density polyethylene. However, other materials such as polypropylene, polybutylene, and the like may be used. Layer 11 is preferably identical in composition to layer 10 and prevents the foil layer 13 and the metal layer 12 and headpiece 9 from chemically reacting with the contents of the tube. Furthermore, layer 11 and layer 10 being barrier polymers will not react with the various oils or other chemicals contained in the product contained in the tube.

Figure 2:
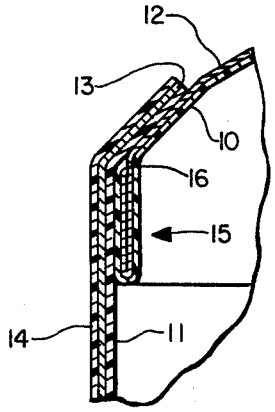

As shown in FIG. 1 and in detail in FIG. 2, to aid in joining the headpiece to the tube, an annular ring 15 is formed around the bottom of headpiece 9 by folding the bottom of headpiece 9 outwardly to expose the inner layer 10 to the outside of the headpiece. Inner layer 10 will directly contact inner layer 11 when headpiece 9 is forced into the tubular body. As shown in FIG. 2, lamina 10 contacts lamina 11 and the tube may be bonded together by heating the area around ring 13.

It is important that the tubular body 8 extend over the exposed edge 16 of headpiece 9. The annular ring 15 is thereby covered from the view of the consumer and presents a pleasing, esthetic appearance.

Furthermore, it is important that the portion of headpiece 9 above edge 16 does not overlap edge 16; instead, said portion curves smoothly toward neck 9*a*.

The metal lamina 12 in headpiece 9 and the metal lamina 13 in body 8 aid in connecting the headpiece to the body by induction welding since the metal in the headpiece and the body quickly heats up and aids in transferring heat to weld the similar plastic materials together. Furthermore, the configuration of the head shown in FIG. 1 results in the removal of the presence of exposed metal edges from contact with the product in the container.

The various lamina may be joined by any conventional technique. Examples of these techniques are gluing, co-extruding, and the like.

The tube body 8 and the headpiece 9 each must have at least two layers but more may be used if desired. The metal laminae 12 and 13 are preferably aluminum foil. Also, headpiece 9 is preferably made from a laminate which may be crushed and collapsed to a degree to aid in further removing product from the container.

Other modifications and variations of the present invention will now be readily apparent in light of the above teachings. It is therefore to be understood that changes may be made in the particular embodiments described above which are within the spirit and intended scope of the invention as defined in the appended claims.

What is claimed:

1. A collapsible dispensing container comprising:

a. laminated tubular body, said laminated tubular body having a metal foil lamination and an inside thermoplastic lamina; and, b. a metal headpiece connected to said laminated tubular body having a neck portion on the upper end, said metal headpiece having a thermoplastic lamina on the inside thereof which is heat fused to said inside thermoplastic lamina of said laminated tubular body, said headpiece having an annular ring therearound on the lower end which exposes said thermoplastic lamina in said headpiece to said inside thermoplastic lamina of said tubular body facilitating fusing said headpiece to said tube by heat fusion, said annular ring having an edge on the outside thereof, the portion of said headpiece above said edge extending upward from and away from said edge toward said neck portion, with said tubular body overlapping and covering said edge and bonding said inside lamina of said tubular body to said outer lamina of said headpiece.

2. The container of claim 1 wherein said laminated tubular body has at least one thermoplastic lamina.

3. The container of claim 1 wherein said thermoplastic lamina in said headpiece is identical in composition to said thermoplastic lamina in said tubular body.

4. The container of claim 3 wherein said laminated tubular body has at least one thermoplasic lamina.

5. The container of claim 4 wherein said laminated tubular body has at least two thermoplastic laminae.

* * * * *